United States Patent [19]

Renshaw

[11] 4,168,719

[45] Sep. 25, 1979

[54] GAS CONTROL UNIT FOR A BURNER

[75] Inventor: Edward J. Renshaw, Castle Douglas, Scotland

[73] Assignee: Steel Radiators Limited, Henley-on-Thames, England

[21] Appl. No.: 783,430

[22] Filed: Mar. 31, 1977

[30] Foreign Application Priority Data

Apr. 6, 1976 [GB] United Kingdom ..... 13940/76

[51] Int. Cl.[2] ..... F16K 51/00; F23N 5/24

[52] U.S. Cl. ..... 137/312; 137/65; 137/505.41; 137/613; 137/625.5; 236/1 E; 431/22

[58] Field of Search ..... 137/65, 312, 613; 431/22, 51, 16; 236/1 E

[56] References Cited

U.S. PATENT DOCUMENTS 3,526,360 9/1970 Ray ..... 137/495 X
3,575,197 4/1971 Ray ..... 137/312
3,999,932 12/1976 Matthews ..... 137/66 X

*Primary Examiner*—William R. Cline
*Assistant Examiner*—Richard Gerard
*Attorney, Agent, or Firm*—Diller, Ramik & Wight

[57] ABSTRACT

A gas control device for controlling the gas supply to the burner of a domestic hot water boiler has two main valves arranged in series in the gas flow path so as when closed to define a chamber between them. A second chamber is communicable with this chamber through an auxiliary valve which is open when the main valves are closed and closed when the main valves are open. A shut-off valve is responsive to the pressure in the second chamber so as to close the flow path if gas leaks through the upstream main valve when supposedly closed. The subsequent closing of the auxiliary valve when the main valves are later opened maintains the pressure in the second chamber so that the shut-off valve remains closed.

11 Claims, 2 Drawing Figures

GAS CONTROL UNIT FOR A BURNER

Figure 1:
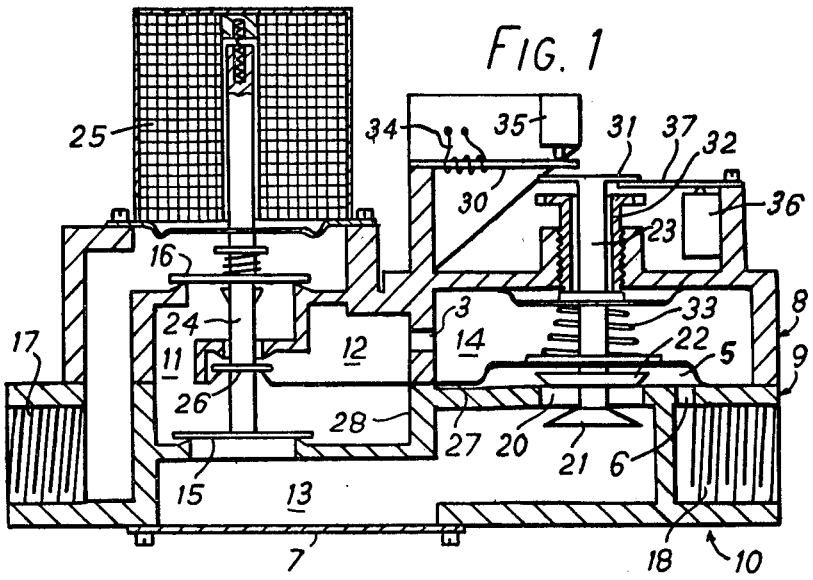

This invention relates to gas control devices for controlling the flow of gas to a burner, particularly, but not exclusively, for a domestic hot water heating system.

According to the invention from one aspect there is provided a gas control device for controlling the flow of gas to a burner which comprises:

a first, upstream main valve and a second, downstream main valve arranged in spaced and series relation to the gas flow path through the device for movement together between open positions in which they allow for gas flow through the device and closed positions in which they close the flow path and segregate a first chamber within the same, a second chamber which is closed when the main valves are closed but which is communicable with the first chamber by an auxiliary valve arranged to open when the main valves are closed and vice versa, and a shut-off valve which is normally open but which is responsive to the gas pressure within the second chamber so as on leakage of gas past the first main valve when supposedly closed, to close an orifice forming part of the gas flow path and, by virtue of closure of the second chamber by the auxiliary valve, to maintain the gas flow path closed when the main valves are subsequently opened.

Figure 2:
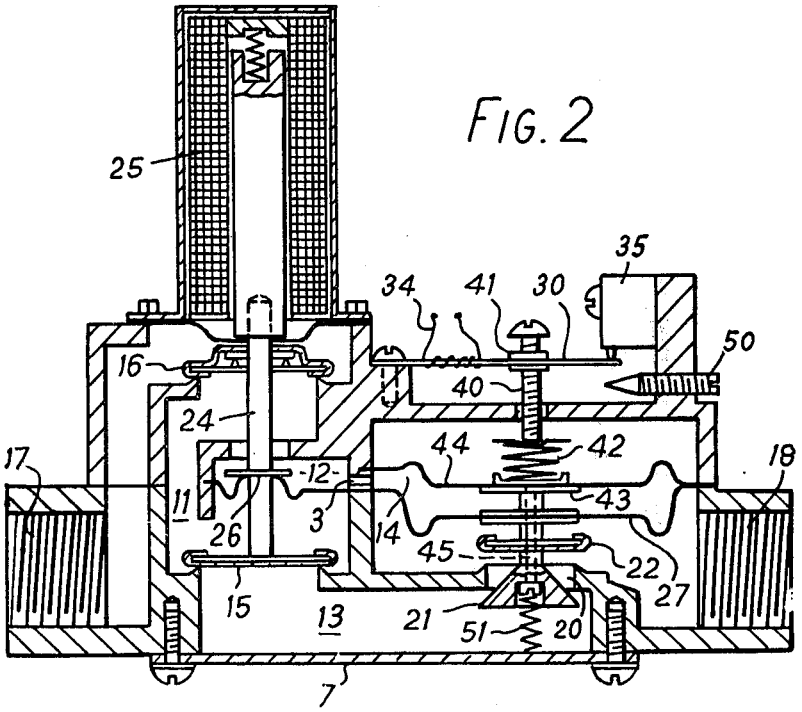

These and other aspects and features of the invention will become apparent from the following description of two embodiments of the invention, given by way of example and with reference to the accompanying drawings. In the drawings:

FIG. 1 is a side elevation of a first control device in accordance with the invention, as seen generally in central vertical section; and FIG. 2 similarly shows a second control device in accordance with the invention.

Referring now to FIG. 1, the first gas control unit comprises a housing 10 in which are formed separate or separable chambers 11, 12, 13 and 14.

The chamber 13 is closed by a removable metal cover plate 7 which provides access for assembly. Otherwise the housing is of cast metal, for manufacturing convenience being formed of two parts 8,9 bolted together by means not shown.

The chambers 11 and 13 are connectable together by a main valve 15 on an axially movable vertical spindle 24 to form a series path for gas flow through the housing. A further main valve 16, also mounted on the spindle 24, is arranged to communicate this series path with the inlet channel 17 for the control unit, as is later to be described. The other end of the series path is communicated with the outlet channel 18 of the control unit by an orifice 20, a chamber 5 and an orifice 6. Gas flow through the orifice 20 is variable by a governor or throttle valve 21 mounted in the chamber 13 on a second axially movable, vertical spindle 23. The spindle 23 also carries, in the chamber 5, a shut-off valve 22 for closing the orifice 20.

The spindle 24 for the main valves 15,16 is actuable by a solenoid 25. In addition to the main valves the spindle 24 carries an auxiliary valve 26 which is arranged to open, to bring the chambers 11 and 12 into communication with each other, when the main valves close and to close when those valves open. When, as shown, the solenoid 25 is unenergised, the main valves are closed and the valve 26 is open.

The chambers 5 and 14 are separated by a flexible diaphragm 27 which is continued through an internal wall 28 of the housing 10 so as also to separate the chambers 11 and 12 from one another. An orifice 3 in the wall 28 communicates the chambers 12 and 14 permanently together.

The governor valve spindle 23 extends from the governor valve 21 upwardly through the diaphragm 27, to terminate at its top free end at a flange 31 which is located outside the housing 10. The spindle is fast and gas-tight with the diaphragm 27; it passes through the housing wall at an adjusting screw 32 which is screw-threaded into the housing and acts on the top end of a conical compression spring 33. The bottom end of this spring 33 is effective upon the diaphragm 27 so as to bias the latter downwardly against the inherent resilience of the diaphragm and, more particularly, against gas pressure which may exist in the chamber 5. It will be seen that by screwing the adjusting screw into and out of the housing, the vertical position of the spindle 23 can be adjusted in relation to the flow-governing orifice 20. In the normal, relaxed position of the diaphragm 27, the valves 21 and 22 are both open.

A limit to movement of the spindle in the upward direction is provided by a bimetallic strip 30 which is mounted on the housing 10 with its free end located over the flange 31 on the spindle 23, for abutment by the flange. The strip has an electric heating coil 34 which is energisable as is later to be described to cause the strip to flex downwardly.

Also provided in the control unit are first and second microswitches 35 and 36 each mounted on the housing 10. Of these, the microswitch 35 is located so as to be held normally closed by the bimetallic strip 30; it is opened when the strip 30 flexes downwardly on energisation of the heating coil 34.

The microswitch 36 has an associated flexible strip 37 which is cantilevered from the housing with its free end located under the flange 31 on the spindle 23. The microswitch is normally held closed by the flange 31, but opens when the spindle 23 rises as is later to be described.

For operation the control unit is associated with an external electric circuit (not shown) which is arranged to energise the solenoid 25 and which has a further output provided by a spark ignition device for a gas burner connected to the outlet channel 18. The circuit is arranged for connection to a domestic 240 volt mains a.c. electric supply and has as control input an electric signal which is generated by a flame detection device (not shown) when the burner is alight.

In order initially to ignite the burner after a period of shut-down, the electric circuit first energises the solenoid 25 to open the first and second main valves 15 and 16, and close the additional valve 26. The valves 15 and 26 operate slightly in advance of the valve 16, so ensuring that no gas enters the chambers 12 and 14 and, moreover, that the valve 15 does not impede gas admitted through the valve 16 from passing quickly to the chamber 13.

Provided that no gas leakage has occurred through the valve 16 during the shut-down period, the pressure of the gas admitted to the chamber 5 from chamber 13 urges the diaphragm 27 upwards and so lifts the governor valve spindle 23 until the flange 31 engages underneath the bimetallic strip 30 and further movement is prevented by the strip. In this position of the spindle a restricted flow of gas is allowed by the governor valve 21 to pass through the orifice 20, chamber 5, orifice 6 and outlet 18 to the burner; the burner accordingly lights up when ignited by the spark ignition device associated with the external electric circuit. As is further explained below, the position of the adjusting screw 32 sets the full flow gas rate. The low rate gas flow is set by the position of microswitch 35 which sets the position of the bimetallic strip 30 so that pressure on diaphragm 27 raises valve 21 and spindle 23 until it reaches bimetallic strip 30. This sets the position of valve 21 in relation to orifice 20, thereby setting the low rate gas flow.

It will be understood that the pressure in chamber 5 is less than that in chamber 13 due to throttling action by valve 21. The spring 33 is such that it balances this reduced pressure, so that if for any reason the latter falls below its predetermined value, spring 33 will tend to open the valve 21 slightly. The gas pressure to the burner is thus automatically kept at a constant value.

In response to a signal from the flame detection device mentioned above, indicating that ignition has been achieved, the external circuit energises the heating coil 34 which accordingly heats the bi-metallic strip 30 and causes it to deflect downwards, so applying a downward force to the spindle 23. This force, together with that of the spring 33, overcomes the gas pressure in chamber 5 and forces the spindle 23 downwards by an amount set by the force exerted by the spring 33 and hence by the position of the adjusting screw 32. This downward movement of the spindle 23 is set to enable gas to flow past the governor valve 21 and valve 22 to the burner at the required full flow gas rate, without, however, closing the valve 22. Because of the substantial thermal inertia of the strip 30, the strip deflection is progressive and relatively slow, and the gas flow to the burner correspondingly increases in a progressive and relatively slow manner until the full gas flow, corresponding to normal operation of the burner is achieved. A period of normal operation then follows until no further demand for heat exists and a thermostat contact (not shown) opens to deenergise the electric circuit and so close the main valves 15,16. The gradual increase in gas flow from the restricted flow rate for ignition to the full flow rate for normal operation is desirable because it reduces the risk of the flame being inadvertently extinguished by gas surges during this time.

The external circuit associated with the control unit is arranged such that the ignition circuit for the burner is energised only if the micro-switch 35 is held closed by the bi-metallic strip 30. If, therefore, the burner flame is lost after the bi-metallic strip 30 has been deflected, reignition of the burner is prevented until the bimetallic strip has eventually returned to its rest or cold position to reclose the micro-switch 35. In this way it is ensured that the full ignition cycle is always used, irrespective of any previous attempt to ignite the burner.

If flame is not proved within a predetermined time, e.g. 8 seconds, of the opening of the main gas valves 15,16, the heating coil 34 is not energised but instead the solenoid 25 is deenergised to close the main valves.

If gas leaks past the first main valve 16 when the control unit is shut down and the main valves 15 and 16 are supposedly closed, the leakage gas passes via the open auxiliary valve 26 into the chamber 12 and from there passes via the orifice 3 into the chamber 14. The pressure which the leakage gas generates in the chamber 14 acts on the upper surface of the diaphragm 27 and forces the spindle 23 down so that the shut-off valve 22 engages a seat around the orifice 20 to close the latter. When, subsequently, the solenoid 25 is operated to open the main valves, the simultaneous closure of the valve 26 traps the leakage gas within the chambers 12 and 14, so maintaining the leakage gas pressure on the diaphragm 27 and preventing the valve 22 from opening, so preventing gas from passing to the burner in the event of main valve leakage. Needless to say, in normal operation when the main valves are not faulty, the closing of the auxiliary valve when the main valves are opened ensures that the pressure in the chambers 12 and 14 does not rise.

The microswitch 36 provides a further safeguard by inhibiting energisation of the control circuit for the burner unless the spindle 23 has been raised by pressure of gas in the chamber 5.

FIG. 2 shows a control device which is a modification of the device of FIG. 1, and which has many similarities to that device. Where appropriate, like reference numerals are therefore used to indicate like parts.

To achieve the movement of the valves 21,22 (FIG. 2) to vary the gas flow rate from the ignition rate to the full burner rate, the bimetallic strip 30 is arranged to flex downwardly as before, when its associated heater coil 34 is energised. The strip movement is referred to the valves 21,22 by means of an adjusting screw 40 which is screwed into a collar 41 fast with the bimetallic strip, a compression spring 42 and a spacer member 43 separating the diaphragm 27 from a further flexible diaphragm 44 which defines the upper boundary of the chamber 14. The valves 21,22 are bolted to the spacer member 43 by a bolt 45 passing through the diaphragm 27, and it will be seen that the components 21, 22, 27 and 40 to 45 move as a single unit to achieve the desired variation of the gas flow rate from the lower value required for ignition to the higher value required for full burner operation.

In the event of gas leakage through the supposedly closed main valve 16 as previously described, the diaphragm 27 moves downwardly as before to close the shut-off valve 22, this movement being accommodated by a gap which opens up between the top of the spacer member 43 and the diaphragm 44. When the main valves are subsequently opened the auxiliary valve 26 closes to maintain the valve 22 closed and prevent gas from passing to the burner.

A light compression spring 51 acts on the underside of the valve 21 to act as a return spring for when the bimetallic strip 30 flexes upwardly or the pressure of leakage gas in the chamber 14 is released. A similar spring may also be provided in the embodiment of FIG. 1, if desired.

As before, the microswitch 35 is arranged to open when the bimetallic strip 30 flexes, so as to ensure that the control circuit cannot be energised for a substantial time period after ignition has occurred and the bimetallic strip has flexed.

A screw 50 having a conical head is arranged to provide an adjustable upper limit for the gas flow rate by engagement with the free end of the bimetallic strip 30.

What we claim is:

1. A gas control device for controlling the flow of gas to a burner, which comprises:

a first, upstream main valve and a second, downstream main valve arranged in spaced and series relation to the gas flow path through the device for movement together between open positions in which they allow for gas flow through the device and a closed position in which they close the flow path and segregate a first chamber within the gas flow path, a second chamber which is closed when the main valves are open but which is communicable with the first chamber through a passage controllable by an auxiliary valve arranged to open when the main valves are closed and close when the main valves are opened, and a shut-off valve which is normally open but which is responsive to the gas pressure within the second chamber so as on leakage of gas past the first main valve when in the closed position, to close an orifice forming part of the gas flow path and, by virtue of closure of the second chamber by the auxiliary valve closing said passage, to maintain the gas flow path closed when the main valves are subsequently opened.

2. A gas control device according to claim 1, wherein the main valves and the auxiliary valve are mounted in spaced relation along a common actuating spindle with the auxiliary valve intermediate the main valves.

3. A gas control device according to claim 1, having a throttling valve arranged in association with the said orifice on the upstream side thereof, the device being arranged so that in normal burner operation, when the main valves are open and substantially no pressure of leakage gas exists in the second chamber, the throttling valve is movable in relation to the orifice so as to vary the rate of gas flow through the device from a lower rate suitable for ignition to a substantially higher rate suitable for full burner operation.

4. A gas control device according to claim 3, arranged so that in normal burner operation, when the main valves are open and substantially no pressure of leakage gas exists in the second chamber, the throttling valve is biassed toward the orifice, the device including a stop member arranged to limit movement of the throttling valve toward the orifice to a first position in which it restricts the gas flow through the device to a first rate suitable for burner ignition, the stop member being operable when ignition is achieved to cause the throttling valve to move to a second position in which it allows gas to pass through the orifice at a second rate substantially higher than the first and suitable for full burner operation.

5. A gas control device according to claim 4, arranged to provide the said bias at least in part by the pressure of gas in the gas flow path downstream of the first chamber.

6. A gas control device according to claim 4 wherein the said stop member comprises a bimetallic strip.

7. A gas control device according to claim 3 which includes a control member arranged to define for the throttling valve a first position in which it restricts the gas flow through the orifice to a first rate suitable for burner ignition, the control member being operable when ignition is proved to move said throttling valve to a second position in which it allows gas to pass through the orifice at a second rate of flow substantially higher than the first and suitable for full burner operation, the movement of the throttling valve from the first to the second position being in the sense to approach the shut-off valve towards the orifice.

8. A gas control device according to claim 7 wherein the said control member comprises a bimetallic strip.

9. A gas control device according to claim 1, wherein the shut-off valve is arranged for actuation by a member by which it is movable in the direction towards the orifice in response to the pressure of leakage gas in the second chamber, and in the direction away from the orifice by the pressure of gas in a third chamber forming part of the gas flow path downstream of the first chamber.

10. A gas control device according to claim 9, wherein said movable member by which the shut-off valve is actuable comprises a flexible diaphragm separating the second and third chambers from one another and defining part of each of these chambers.

11. A gas control device according to claim 9 wherein the throttling valve is mounted with the shut-off valve so as to be actuable simultaneously therewith by the said movable member by which the shut-off valve is actuable.

* * * * *